US006070856A

United States Patent [19]

Alten

[11] Patent Number: 6,070,856

[45] Date of Patent: Jun. 6, 2000

[54] CAR JACK

[75] Inventor: Ferdinand Alten, Mandern, Germany

[73] Assignee: Krupp Bilstein GmbH, Ennepetal, Germany

[21] Appl. No.: 09/201,230

[22] Filed: Nov. 3, 1998

[30] Foreign Application Priority Data

May 2, 1998 [DE] Germany ..... 198 04 334

[51] Int. Cl.[7] ..... B66F 3/00

[52] U.S. Cl. ..... 254/126; 254/133 R; 254/122; 254/124

[58] Field of Search ..... 254/122, 126, 254/124, 133 R

[56] References Cited

U.S. PATENT DOCUMENTS

| | | | |
|---|---|---|---|
| 3,317,187 | 5/1967 | Steppon | 254/124 |
| 4,765,595 | 8/1988 | Alten | 254/126 |
| 5,118,083 | 6/1992 | Metzen | 254/126 |
| 5,275,378 | 1/1994 | Alten | 254/126 |

*Primary Examiner*—David A. Scherbel
*Assistant Examiner*—Lee Wilson
*Attorney, Agent, or Firm*—Max Fogiel

[57] ABSTRACT

A jack with a leg (1) and a supporting arm (2) articulated together by an articulation (3). The leg rests against the ground (5) by way of a foot (4). The supporting arm is articulated by another articulation (18) at the other end of the supporting arm to a load-support plate (19). The plate supports the vehicle as it is lifted by way of an innermost section (20) located preferably between the sill ridge (21) and the midline, and below the bottom (22), of the vehicle. The plate has a bodywork catch (25) with a bent-up section (26). The bent-up section comes to rest against the outside (23) of the sill (24) when the jack is used and is raised by a spring (28). Adjusting arms (9& 10) are articulated to the leg, to the supporting arm, and to each other, constituting a parallelogram linkage. One end (17) of the supporting arm projects beyond its articulation (7) to its associated adjusting arm (9). A threaded displacement shaft (12) is connected at one end to an articulation (11) between the adjusting arms and at the other to the articulation (3) between the leg and the supporting arm.

11 Claims, 3 Drawing Sheets

CAR JACK

The present invention concerns a jack with an upright leg and a horizontal supporting arm connected into a parallelogram by struts. The jack has a load-support plate with a bodywork catch at the side outside the automobile's sill. One section of the bodywork catch is bent up and rests against the outside of the sill when the jack is in use. A jack of this genus is known from German 8 513 830 U1.

It is difficult to use jacks on motor vehicles with very low sill ridges because it is so hard to locate the point of application. The load-support plates on some jacks are accordingly provided with bodywork catches, allowing the jack to be applied to the visible outer surface of the sill with no need to establish where the ridge is. The bodywork catch is forced up by a spring. It is known that the application position, the height the jack is extended to beneath the vehicle, that is, can vary widely, because the vehicle's suspension can vary widely in accordance with load when the jack is used to change an inflated tire. The application position, and accordingly the height of the jack, will be lower, however, when a tire is flat and the vehicle is resting on a rim. It is accordingly impossible to ensure that the bodywork catch of the load-support plate in a state-of-the-art jack is resting securely against the outside of the sill while the load-support plate is inserted below the ridge at not too great a distance to allow the jack to be used properly below the bottom of the vehicle.

The object of the present invention is accordingly a jack that can be extended to any extent below the vehicle with its load-support plate and bodywork catch precisely positioned in relation to the sill and sill ridge.

This object is attained in accordance with the present invention as recited in the body of claim 1. Claims 2 through 11 recite various advantageous and advanced embodiments.

One major advantage of the present invention is that the jack can be applied simply and precisely against deep-drawn sills. Another is that the jack and its load-support plate can be employed in more or less the same state no matter how low the vehicle has descended. The jack will in particular remain entirely upright, eliminating the risk of its engaging outside the friction cone and slipping in under the vehicle.

Figure 1:
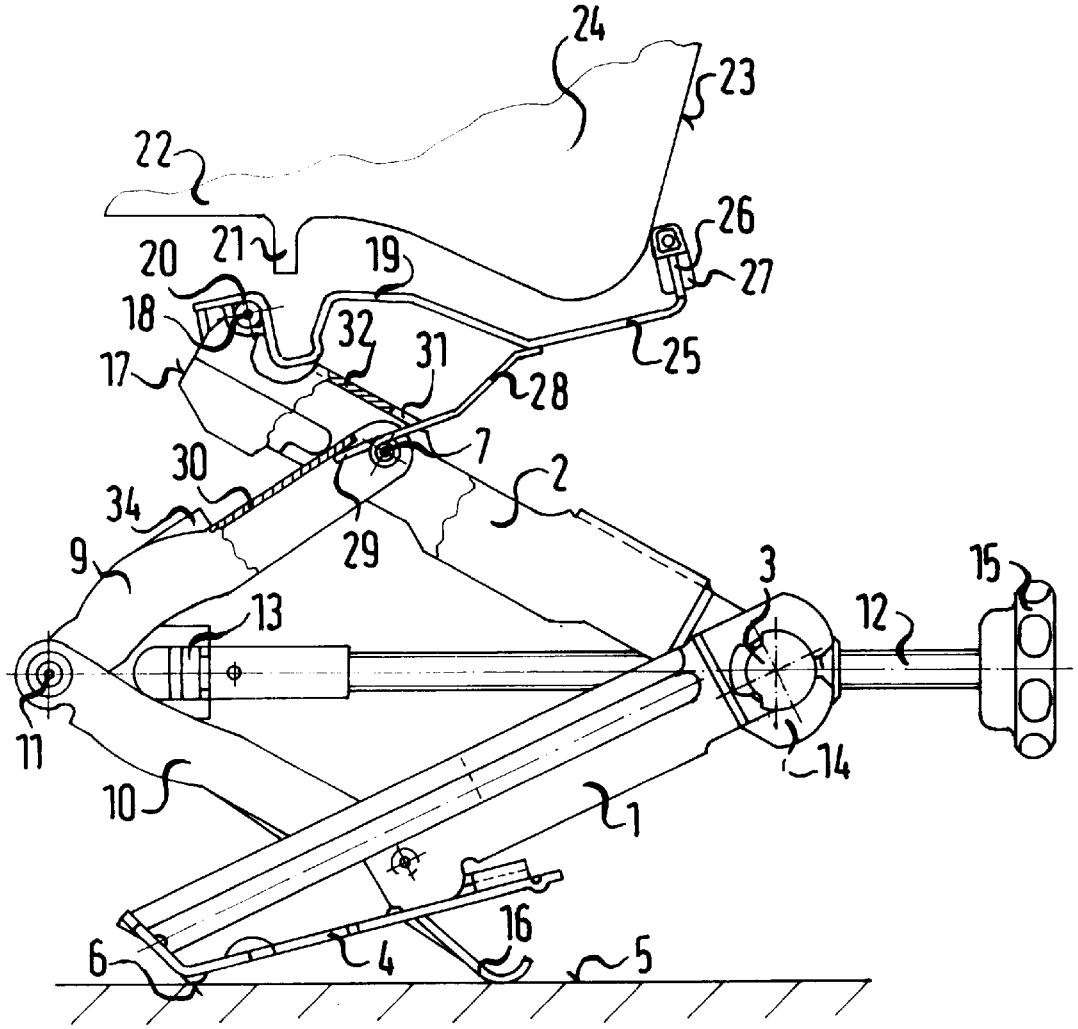
Figure 2:
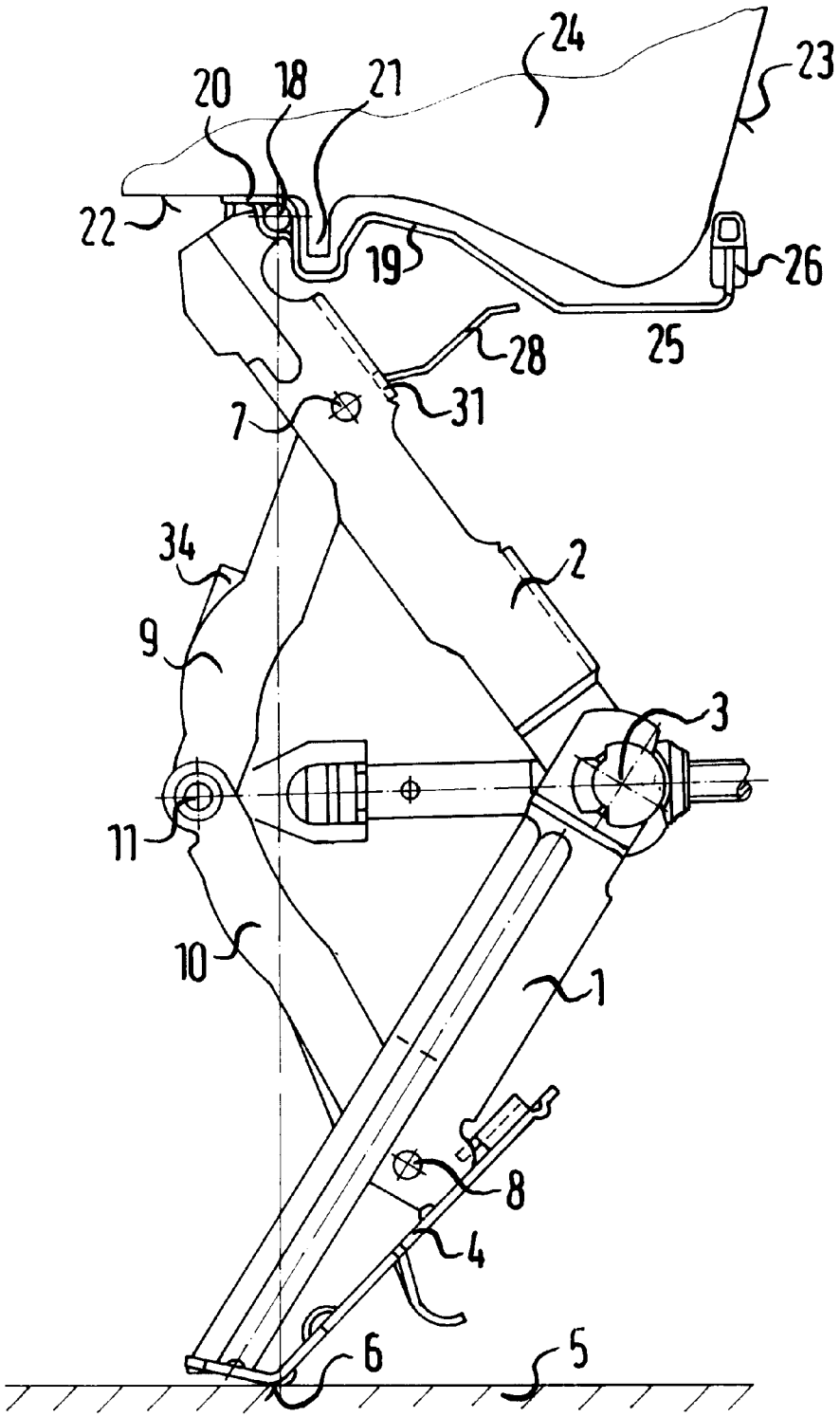
Figure 3:
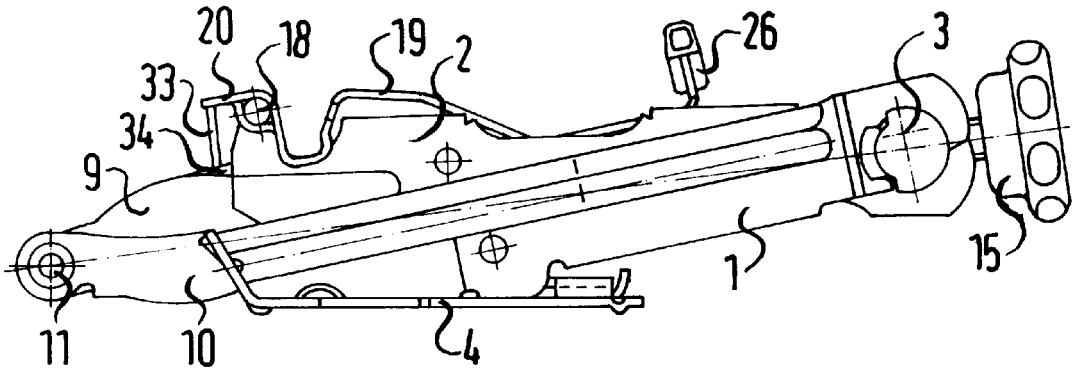

The present invention will now be specified with reference to the accompanying drawing, wherein FIG. 1 illustrates the jack ready to use, FIG. 2 the jack fully extended, and FIG. 3 the jack collapsed.

The illustrated jack comprises a leg 1 and a supporting arm 2 articulated together at an articulation 3. Leg 1 rests against the ground 5 on a foot 4. The foot 4 in the illustrate example is fixed to leg 1. Such a "tilting" foot tilts forward around a fulcrum 6 at one edge along with leg 1. Adjusting arms 9 and 10 are articulated to leg 1 and to supporting arm 2 at articulations 7 and 8 and together at an articulation 11. Adjusting arms 9 and 10 project beyond articulations 7 and 8. A threaded displacement shaft 12 engages articulation 11 by way of a rotating bearing 13 and articulation 3 by way of a nut 14. Displacement shaft 12 can be manipulated to extend the jack by a manually operated wheel 15. In actual practice however, the jack is extended and the vehicle lifted using an unillustrated manually operated crank fixed to wheel 15. The illustrated jack accordingly constitutes a parallelogram linkage.

The end of adjusting arm 10 next to leg 1 terminates in an adjusting strip 16. This is a conventional component of jacks with a tilting foot and of jacks with an articulating foot, and ensures that the jack will remain perpendicular to the ground when in use.

A load-support plate 19 is articulated to the projecting end 17 of supporting arm 2 at an articulation 18. As will be evident from FIGS. 1 and 2, load-support plate 19 includes an innermost section 20 that rests below the bottom 22 of the vehicle against the section of sill adjacent to sill ridge 21 and toward the vehicle's midline when the jack is in position. Load-support plate 19 extends beyond the outside 23 of sill 24 into a bodywork catch 25. Bodywork catch 25 terminates in a bent-up section 26 inserted in a length 27 of plastic structural section that protects the sill's enamel when the jack is in use.

How the jack is used will now be specified with reference to FIG. 1. The jack is extended by means of wheel 15 until the bent-up section 26 of bodywork catch 25 rests against the outside 23 of sill 24. This stage of the operation ensures that load-support plate 19 and innermost section 20 will engage below the bottom 22 of the vehicle properly and precisely.

To ensure that load-support plate 19 will engage while in more or less the same state, the bottoms of vehicles at various levels of descent with bent-up section 26 resting properly against the outside 23 of sill 24 and with the innermost section 20 of load-support plate 19 readily sliding in beyond sill ridge 21, the jack is provided with a spring 28 that controls the position of load-support plate 19. Spring 28 extends more or less out in alignment with articulations 11 and 7 and beyond supporting arm 2 to the bodywork catch 25 on load-support plate 19. Spring 28 winds at least once around the bolt that constitutes articulation 7, and its inner end 29 rests against the base 30 of the U section that adjusting arm 9 is composed of. Spring 28 will accordingly always more or less parallel the section between articulations 11 and 7 and extend out beyond adjusting arm 9.

Although the spring 28 in the illustrated embodiment is of steel wire, it could alternatively be plastic and even a leaf spring.

Spring 28 projects out more or less the distance between articulations 7 and 18 and forms in conjunction with those articulations and with bodywork catch 25 ab equilateral triangle. Since the projecting end 17 of supporting arm 2 and the projecting end of spring 28 execute more or less the same angular motions as adjusting arm 9 but in the opposite sense, load-support plate 19 is maintained at more or less the same angle.

Supporting arm 2 is also a length of more or less U-shaped metal section. Spring 28 extends through a slot 31 in the base 32 of the section, terminating in the vicinity of the projecting end 17 of supporting arm 2. While the jack is fully extended, for use with a fully inflated tire for example, the projecting end of spring 28 will rest against the end of slot 31, and will then be pivoted back into the position illustrated in FIG. 2. This feature of the present invention is intended to prevent the spring from interfering while the vehicle is being lifted. Otherwise, the spring could in particular jam against the load-support plate 19 while the vehicle is being lowered.

The collapsed jack can be conventionally stowed in the vehicle's trunk. To minimize the necessary space, it should be collapsed as completely as possible. FIG. 3 illustrates the collapsed jack. To prevent spring 28 from forcing load-support plate 19 away from supporting arm 2 while the jack is in this state, the supporting end of load-support plate 19 is provided with a bent-down tab 33 that comes to rest against the base 30 of the structural section comprising adjusting arm 9, which is provided with a matching depression 34, as the jack is collapsed. As tab 33 comes to rest against base 30, innermost section 20 will lift off supporting arm 2 and come to rest at least almost entirely against bodywork catch 25. Supporting arm 2 can also be provided with cutouts to allow bodywork catch 25 to be accommodated inside supporting arm 2 as illustrated in FIG. 3. Pivoting load-support plate 19 will tension spring 28, preventing to advantage load-support plate 19 from flapping against the rest of the collapsed jack.

List of Parts

1. leg
2. supporting arm
3. articulation
4. foot
5. ground
6. fulcrum
7. articulation
8. articulation
9. adjusting arm
10. adjusting arm
11. articulation
12. displacement shaft
13. rotating bearing
14. nut
15. wheel
16. adjusting strip
17. projecting end
18. articulation
19. load-support plate
20. innermost section
21. sill ridge
22. bottom
23. outside of sill
24. sill
25. bodywork catch
26. bent-up section
27. length of structural section
28. spring
29. inner end
30. base

What is claimed is:

1. Jack with a leg (1) and a supporting arm (2) articulated together by an articulation (3), whereby the leg rests against the ground (5) by way of a foot (4) and the supporting arm is articulated by another articulation (18) at the other end of the supporting arm to a load-support plate (19), whereby the plate supports the vehicle as it is lifted by way of an innermost section (20) located preferably between the sill ridge (21) and the midline, and below the bottom (22), of the vehicle, and a has a bodywork catch (25) with a bent-up section (26), whereby the bent-up section comes to rest against the outside (23) of the sill (24) when the jack is used and is raised by a spring (28), and with adjusting arms (9 & 10) articulated to the leg, to the supporting arm, and to each other, constituting a parallelogram linkage, whereby one end (17) of the supporting arm projects beyond its articulation (7) to its associated adjusting arm (9), and with a threaded displacement shaft (12) connected at one end to an articulation (11) between the adjusting arms and at the other to the articulation (3) between the leg and the supporting arm, characterized in that a spring (28) is mounted on the adjusting arm (9) articulated to the supporting arm (2) and extends more or less in a straight line toward the adjusting arm's articulations (7 & 11) and beyond the arm, with one end supporting the bottom of the bodywork catch on the load-support plate.

2. Jack as in claim 1, characterized in that the spring (28) is made of wire.

3. Jack as in claim 1, characterized in that the midsection of the spring (28) wraps around a bolt that constitutes the articulation (7) between the supporting arm (2) and its associated adjusting arm (9) and the inner end (29) of the spring rests, when the arm is, as is preferable, a length of U-shaped structural section, against the base (30) of that section.

4. Jack as in claim 1, characterized in that the spring (28) raises the load-support plate (19) when the jack is in use high enough for the bodywork catch (25) to come to rest against the outside of the sill (24) with the inner section of the load-support plate (19) still below the sill ridge (21).

5. Jack as in claim 1, characterized by a stop that limits the motion of the spring (28) when the jack is extended beyond the state it is used in.

6. Jack as in claim 5, characterized in that the stop is on the supporting arm (2).

7. Jack as in claim 1, characterized by mechanisms that force the load-support plate (19) more or less tight against the supporting arm (2) when the jack is collapsed.

8. Jack as in claim 7, characterized in that the load-support plate (19) has a stabilizing projection at the supporting-section end, one end of which comes to rest against the advancing adjusting arm (9) as the jack is collapsed and tensions the load-support plate (19) against the force exerted by the spring (28).

9. Jack as in claim 8, characterized in that the load-support plate (19) comes to rest against the supporting arm (2) against the force exerted by the spring (28) when the jack is collapsed.

10. Jack as in claim 7, characterized in that the stabilizing projection is a bent-down tab (33) on the load-support plate (19).

11. Jack as in claim 7, characterized in that at least part of the load-support plate (19) enters the structural section of the supporting arm (2).

* * * * *